US006036589A

United States Patent [19]

Reilly et al.

[11] Patent Number: 6,036,589

[45] Date of Patent: Mar. 14, 2000

[54] CLEANER FOR A BELT SANDER

[76] Inventors: Cliff Reilly, 1694 Claas Ave., Holbrook, N.Y. 11741; James T Kelly, 111 S0 Centre Ave., Apt 355, Rockville Centre, N.Y. 11570

[21] Appl. No.: 09/179,384

[22] Filed: Oct. 27, 1998

[51] Int. Cl.[7] ..... B24B 53/10

[52] U.S. Cl. ..... 451/444; 451/443; 451/355

[58] Field of Search ..... 451/56, 443, 444, 451/355; 15/22.3, 47, 99

[56] References Cited

U.S. PATENT DOCUMENTS

| | | | |
|---|---|---|---|
| 3,753,269 | 8/1973 | Budman | 451/444 |
| 4,334,390 | 6/1982 | Sumerau | 451/355 |
| 4,574,531 | 3/1986 | Mccurry | 451/355 |
| 4,720,939 | 1/1988 | Simpson | 451/444 |
| 4,815,238 | 3/1989 | Simpson et al. | 451/444 |
| 5,291,693 | 3/1994 | Nguyen | 451/444 |
| 5,484,323 | 1/1996 | Smith | 451/444 |
| 5,620,361 | 4/1997 | Aylesworth | 451/444 |
| 5,692,947 | 12/1997 | Talieh et al. | 451/443 |

*Primary Examiner*—Eileen P. Morgan
*Attorney, Agent, or Firm*—Collard & Roe, PC

[57] ABSTRACT

A cleaner for a belt sander comprising a mounting plate pivotally coupled to a supporting plate having a cleaning block mounted thereon. The mounting plate is adapted to be mounted to the cover of a belt sander. When the two plates are pivoted closed, the cleaning block is facing away from the abrasive belt of the belt sander so that the sander can be used for sanding. When it is desired to clean the belt, the plates are pivoted open, so that the cleaning block rests against the belt and can clean the belt as it rotates through the sander. The cleaner is especially adapted for use on portable belt sanders.

5 Claims, 2 Drawing Sheets

CLEANER FOR A BELT SANDER

BACKGROUND OF THE INVENTION

1. Field of the Invention

This invention relates to a cleaning device for a belt sander. In particular, the invention relates to a cleaning pad that is hinged to the cover of a portable belt sander and which can be pressed against the sanding belt to clean it of accumulated sawdust and debris.

2. The Prior Art

When using a belt sander, the sanding belt often becomes clogged with sawdust and/or other debris, which makes the belt less efficient for sanding. It is therefore necessary to periodically clean the belt during use.

Several attempts have been made to construct cleaners for belt sanders. U.S. Pat. No. 4,720,939 to Simpson et al. discloses a wide belt sander cleaning device comprising a frame connected to the sander and supporting a rubber cleaning block. The block is moved into position against the sanding belt by a mechanism on the frame to rub off any accumulated sawdust. The device is hydraulically operated. U.S. Pat. No. 5,484,323 to Smith discloses another belt cleaner for a wide belt sander comprising a frame mounted to the top roller of the belt sander which pushes a cleaning block into contact with the belt when cleaning is desired.

While these cleaners are suitable for wide belt free standing sanders, they cannot be used on portable belt sanders as they are too cumbersome. A solution to this problem is to use a separate cleaning block that is pressed against the belt when cleaning is desired. However, this requires the user to bring the block with them and to have it handy during use.

SUMMARY OF THE INVENTION

It is therefore an object of the present invention to provide a device for cleaning a portable belt sander.

It is another object of the invention to provide a belt sander cleaner that is simple to manufacture and install, and which is inexpensive.

It is a further object of the invention to provide a belt sander cleaner that is attached to the sander so that it is always handy.

These and other objects are accomplished by a cleaner for a belt sander comprising a mounting plate and a supporting plate that are pivotally coupled together. A cleaning block is mounted to the supporting plate. The mounting plate is adapted to be mounted to the cover of a belt sander. When the two plates are pivoted closed, the cleaning block is facing away from the abrasive belt of the belt sander so that the sander can be used for sanding. When it is desired to clean the belt, the plates are pivoted open, so that the cleaning block rests against the belt and can clean the belt as it rotates through the sander. The user may want to press the cleaning block against the belt for better cleaning.

The cleaning block is preferably made of rubber. However, other suitable materials could be used. All that is required is that the block be capable of removing debris from the belt as it rotates. In a preferred embodiment, the mounting plate, supporting plate and cleaning block are four inches across, which matches the dimensions of a standard belt on a portable belt sander.

The mounting plate can be attached to the cover of the belt sander by any suitable means, but it is preferable to screw the mounting plate on with screws extending through apertures drilled into the mounted half of the plate. The mounting plate is preferably connected to the supporting plate by a hinge.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
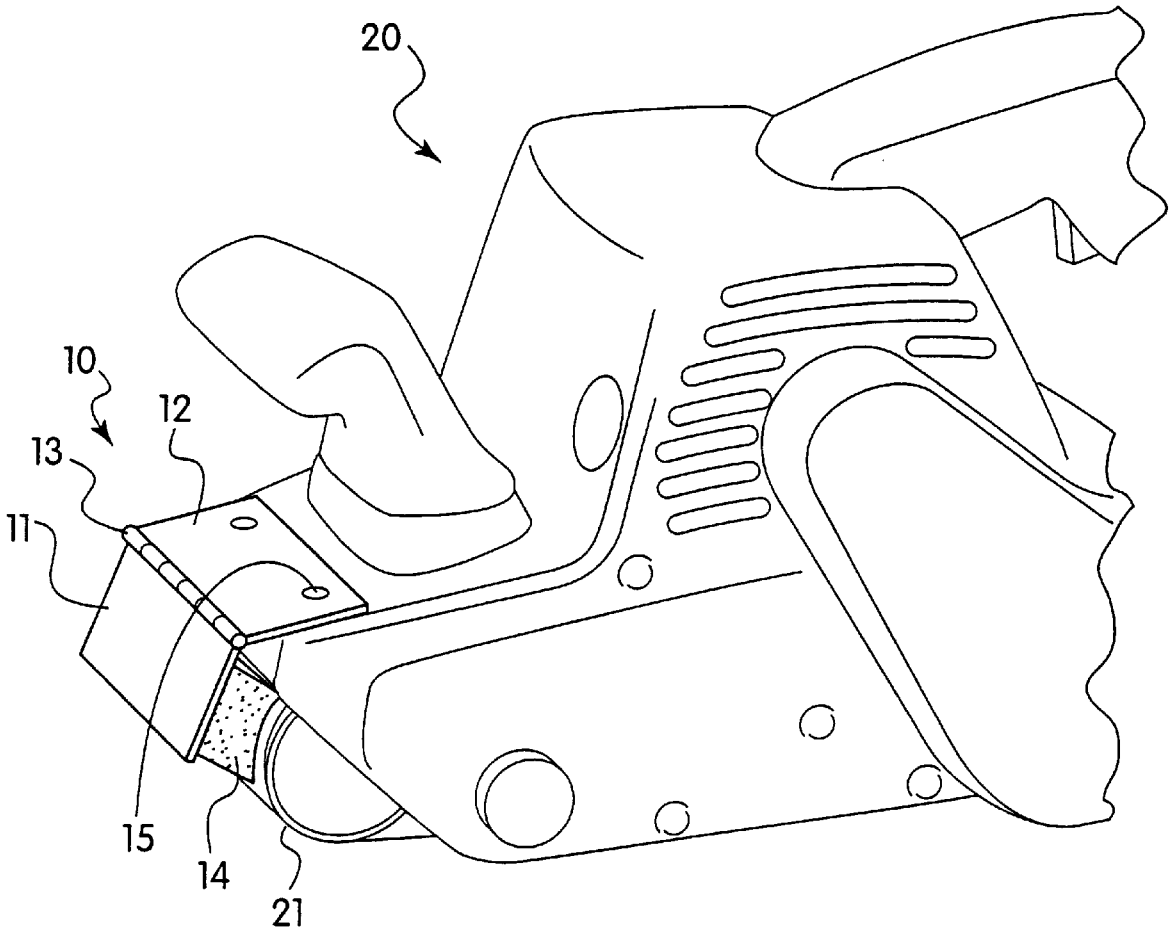
FIG. 1 shows a side view of a portable belt sander having the cleaner of the present invention attached in the sanding position.
Figure 2:
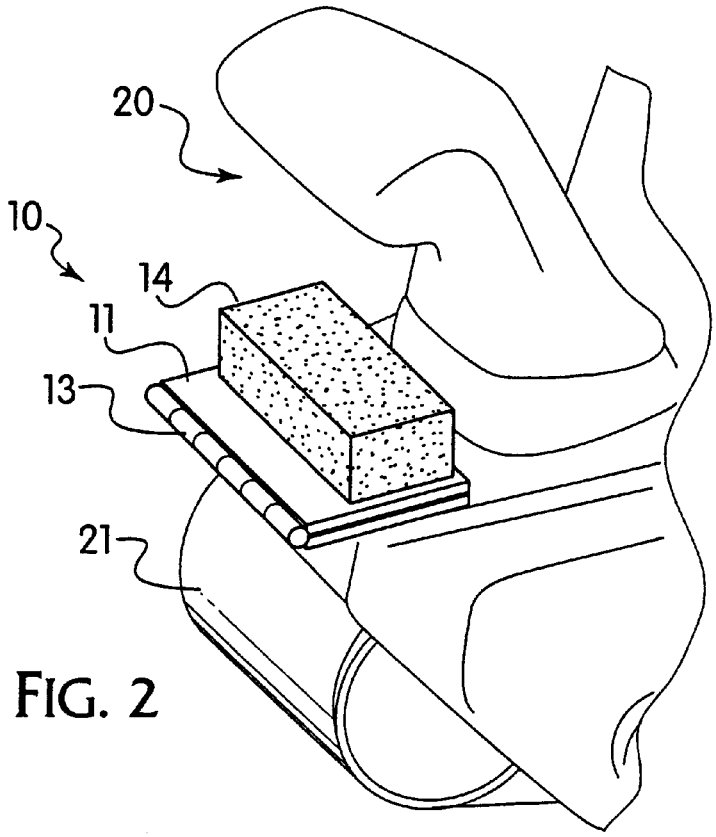
FIG. 2 shows a side view of the embodiment shown in FIG. 1 with the cleaner in the cleaning position.
Figure 3:
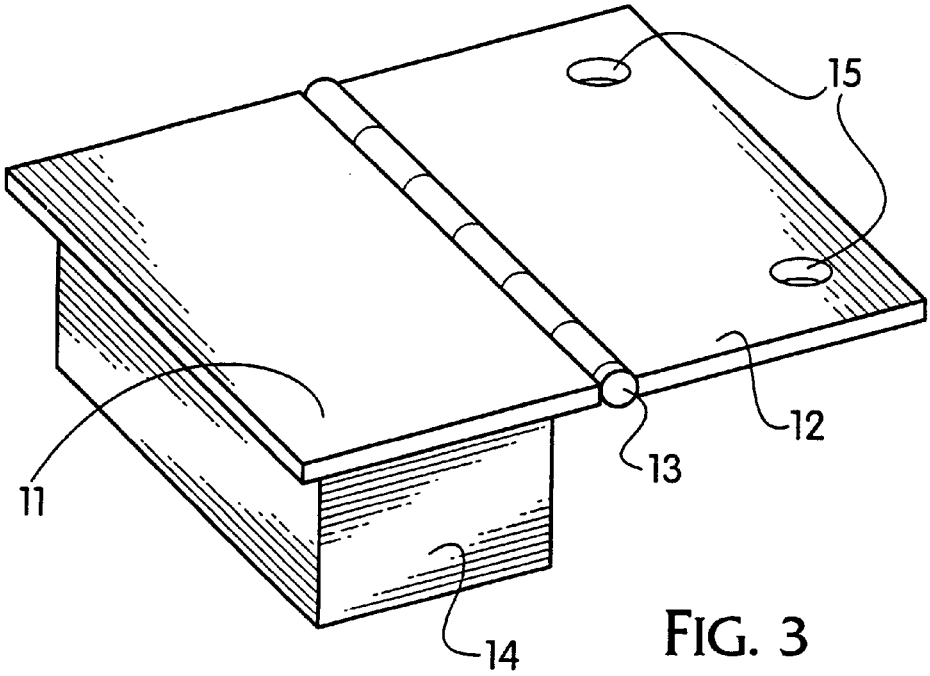
FIG. 3 shows a perspective view of the cleaner according to the invention.

Referring now in detail to the drawings and, in particular, FIGS. 1–3 show the cleaner 10 according to the invention connected to a portable belt sander 20. Cleaner 10 comprises a mounting plate 12 connected via a hinge 13 to a supporting plate 11. A rubberized cleaning block 14 is attached to one side of plate 11. As shown in FIG. 1, block 14 is pressed against the belt 21 of belt sander 20 when the belt is to be cleaned. When cleaner 10 is not in use, plate 11 is flipped on top of plate 12 to keep block 14 out of the way, as shown in FIG. 2. Plate 12 has screw holes 15, which enable cleaner 10 to be attached to belt sander 20 via screws.

Accordingly, while only one embodiment of the present invention have been shown and described, it is obvious that many changes and modifications may be made thereunto without departing from the spirit and scope of the invention.

What is claimed is:

1. A cleaner for a belt sander having a rotating abrasive belt and a cover, comprising:

a mounting plate adapted to be mounted to the cover of a belt sander;

a supporting plate pivotally connected to the mounting plate; and a cleaning block mounted to the supporting plate, such that when the supporting plate is folded together with the mounting plate, the cleaning block is kept away from the abrasive belt and when the supporting plate is pivoted away from the mounting plate, the cleaning block contacts the abrasive belt.

2. The cleaner according to claim 1, wherein the cleaning block is made of rubber.

3. The cleaner according to claim 1, wherein the cleaning block is four inches across.

4. The cleaner according to claim 1, wherein the the mounting plate has a plurality of apertures for receiving screws to screw the plate to the belt sander.

5. The cleaner according to claim 1, wherein the mounting plate is connected to the supporting plate via a hinge.

* * * * *